US007594532B2

(12) United States Patent
Hirata et al.

(10) Patent No.: US 7,594,532 B2
(45) **Date of Patent: *Sep. 29, 2009**

(54) METHOD OF OPERATION FOR AN APPARATUS FOR MAKING AN UPPER AND A LOWER MOLD AND THE APPARATUS THEREFOR

(75) Inventors: Minoru Hirata, Toyokawa (JP); Takayuki Komiyama, Toyokawa (JP); Toshihiko Oya, Toyokawa (JP); Tsuyoshi Sakai, Toyokawa (JP); Koichi Sakaguchi, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 89 days.

This patent is subject to a terminal disclaimer.

(21) Appl. No.: 11/882,215

(22) Filed: Jul. 31, 2007

(65) Prior Publication Data

US 2008/0135201 A1 Jun. 12, 2008

(30) Foreign Application Priority Data

Dec. 6, 2006 (JP) ..... 2006-329070
May 18, 2007 (JP) ..... 2007-132328

(51) Int. Cl.
*B22C 15/08* (2006.01)
*B22D 46/00* (2006.01)

(52) U.S. Cl. ..... 164/456; 164/151; 164/155.3; 164/154.8; 164/207

(58) Field of Classification Search ..... 164/456, 164/29, 151, 155.3, 154.8, 207
See application file for complete search history.

(56) References Cited

U.S. PATENT DOCUMENTS

RE28,735 E 3/1976 Lund et al.
4,411,303 A * 10/1983 Shioda ..... 164/182
2008/0138457 A1 6/2008 Hirata et al.

FOREIGN PATENT DOCUMENTS

EP 1 208 928 A9 5/2002
EP 1 695 776 A1 8/2006
EP 1 726 382 A1 11/2006
JP 4-274838 9/1992
WO WO 2005/058528 A1 6/2005

* cited by examiner

*Primary Examiner*—Kuang Lin
(74) *Attorney, Agent, or Firm*—Finnegan, Henderson, Farabow, Garrett & Dunner, L.L.P.

(57) ABSTRACT

A method of controlling the operation of an apparatus for making an upper and a lower mold and the apparatus therefore that prevents a mold from having a wrap or a match plate from being damaged. The apparatus controls the forward movement of an upper and a lower squeeze member such that when each moves forward to the match plate by a squeeze device, the difference in the squeeze forces imparted to the upper squeeze member and the squeeze force imparted to the lower squeeze member, is kept within the predetermined tolerance.

4 Claims, 3 Drawing Sheets

METHOD OF OPERATION FOR AN APPARATUS FOR MAKING AN UPPER AND A LOWER MOLD AND THE APPARATUS THEREFOR

TECHNICAL FIELD OF THE INVENTION

This invention relates to a method of operation for an apparatus for making an upper and a lower mold and the apparatus therefore. More specifically, it relates to the method for making an upper and a lower mold, which method can prevent a mold that is molded from having a wrap or a match plate from being damaged, and the like, and it also relates to the apparatus therefore.

Conventionally, one representative apparatus for making an upper and a lower stacking flask-less mold comprises:

two pairs of the cope and drag flasks, which flasks have an intake of blown sand on each side wall;

a match plate disposed between one of the two pairs of the cope and drag flasks so that the match plate can be inserted and taken out by a conveying unit;

a sand-squeeze unit for a mold having an upper and lower squeeze means disposed on the open sections of the cope and drag flask, which sections have no match plate, so that the squeeze means can enter or exit freely, wherein the match plate that is sandwiched by the pair of the cope and drag flasks, and wherein the sand-squeeze unit supports the pair of the cope and drag flasks that sandwich the match plate, so that the pair of the cope and drag flasks can rotate around a supporting axis, either in a forward or backward direction in a perpendicular plane, between where the pair of the cope and drag flasks are in a vertical position and where the pair of the cope and drag flasks are in a horizontal position;

a rotary-driving unit that rotates forward or backward the sand-squeeze unit for the mold;

a sand-blowing unit, wherein molding sand is blown through an sand filling port (sand blowing nozzle) for blown sand into a pair of cope and drag flasks that are placed in a vertical position by a rotating unit;

a mold-stripping unit that strips the upper and lower molds within the cope and drag flasks, which molds are stacked and are laid in a horizontal position;

a flask-rotating unit that can rotate in turn and intermittently the two pairs of the cope and drag flasks between the sand-squeeze unit for the mold where one pair of the cope and drag flasks are laid in a horizontal position, and the mold stripping unit, the two pairs of the cope and drag flasks being laid in a horizontal formation, each pair having one flask on top of the other, and that also can lift and lower the cope flask.

(Patent publication 1)

[Patent Publication] W02005/058528 A1

However, a conventional apparatus for making an upper and a lower mold thus formed has problems such as:

a mold that is molded often has a wrap or even has a match plate damaged, in the worst case. This is because there may be a difference in the advancing speeds or squeeze forces between the upper and lower squeeze means, a difference in the pattern shapes between both planes of the match plate, a difference in the thickness between the upper and the lower mold, a difference in the densities of the sand filled in the molding spaces of the upper and the lower mold, and the like.

Thus, there is a difference in the forces that each of the upper and lower squeeze means receives when each is forwarded to the match plate. Then, the squeeze forces caused by the driving means that forward the upper and lower squeeze means become different for each of the upper and lower squeeze means. This makes one of the squeeze forces abnormally larger.

SUMMARY OF THE INVENTION

In view of the above problems this invention is intended to provide a method of operation for an apparatus for making an upper and a lower mold and an apparatus therefor that can prevent a mold that is molded from having a wrap or a match plate from being damaged.

The method of operation for an apparatus for making an upper and a lower mold of the present invention, the apparatus comprises:

a molding unit having:

a cope and a drag flask which hold a match plate between them;

an upper squeeze member which is inserted in an open section of the cope flask, which section has no match plate, and which can form a space to mold the upper mold in combination with the cope flask; and a separating means which is installed on the cope flask to separate the upper squeeze member from the match plate;

an actuator having:

an upper squeeze means to press an upper squeeze member to the match plate;

a molding frame and a lower squeeze member, both of which together can form, in combination with the drag flask, a space to mold a lower mold; and a lower squeeze means to press the lower squeeze member to the match plate;

a driving unit which drives the upper and the lower squeeze means; and a conveying means having a rotating frame which can rotate upward or downward in a perpendicular plane, wherein the method of operation for the apparatus for making an upper and a lower mold is constituted in such way that the molding unit is moved into or out of the actuator by using the rotating frame; and wherein when the upper and lower squeeze members are advanced to the match plate by using the upper and lower squeeze means, the forward movements of the upper squeeze member and the lower squeeze member are controlled so as to keep within a certain tolerance the difference between the upper squeeze forces that the upper squeeze member receives from the upper squeeze means and the lower squeeze force that the lower squeeze member receives from the lower squeeze means.

In another aspect of the present invention the apparatus for making an upper and a lower mold using the operation method comprises:

measuring means attached to the driving units, to measure each of the forces of the upper and lower squeeze members during the squeezing; and a command transmitter means, after the difference between the squeeze forces measured for the upper and lower squeeze means is calculated and the difference thus calculated is compared with the tolerance, instructing the driving unit that, based on the results of the comparison, the advancing movement of the upper squeeze member, the lower squeeze member or both be interrupted or slowed until the difference between the forces becomes less than the tolerance.

Figure 1:
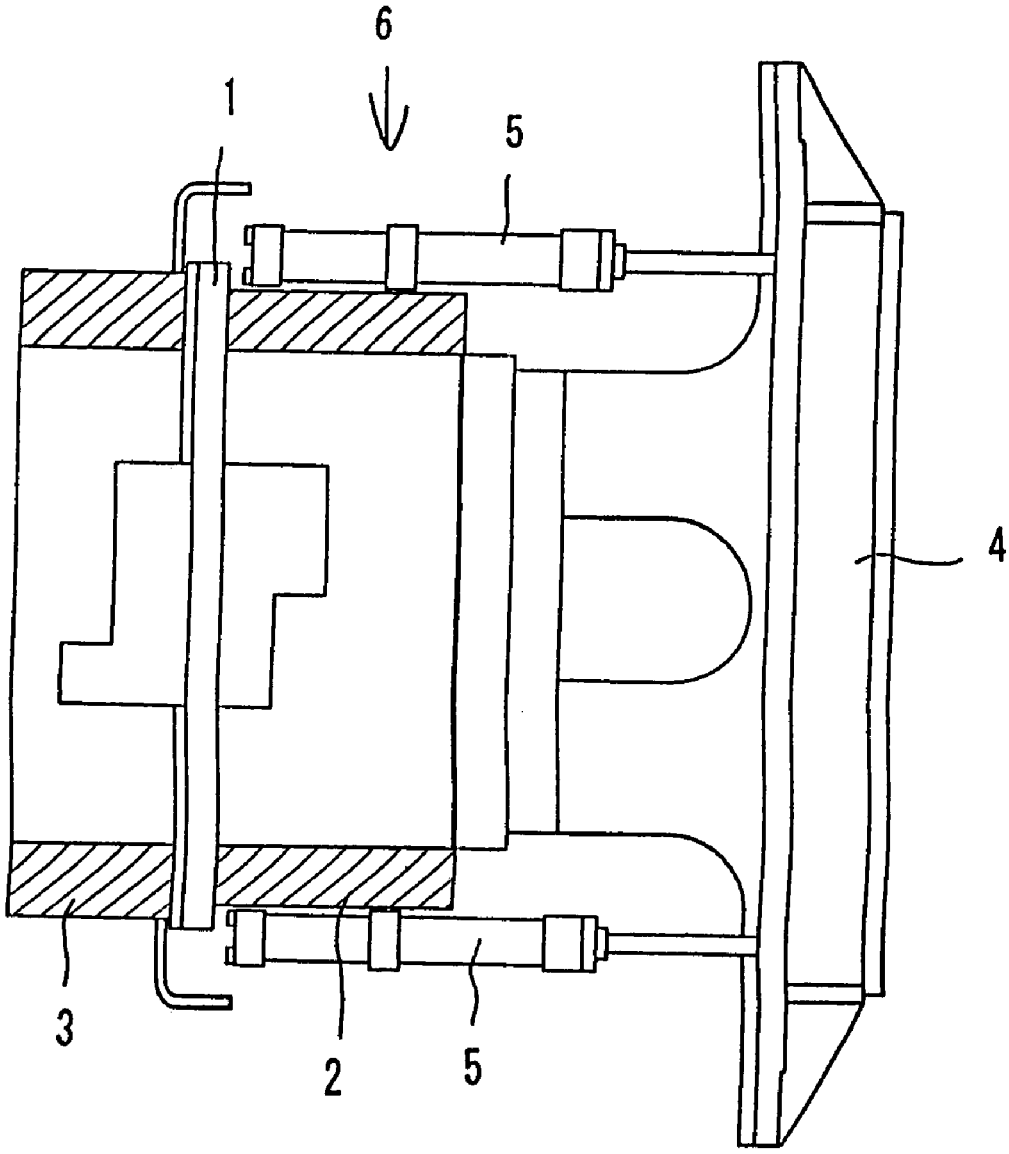
FIG. 1 is a schematic diagram of the main portion of the apparatus for an upper and a lower flask-less mold in one embodiment of the present invention.

This apparatus for making an upper and a lower mold is constituted such that after the molding unit is brought into the actuator by the conveying means, the upper and lower squeeze members are advanced to the match plate by the upper and lower squeeze means, and the molding sand within the upper and lower molding spaces of the upper and lower molds is squeezed, and such that the difference in the forces between those of the upper and lower squeeze means is calculated, based on the results as measured by the measuring means, and the calculated results are compared with the tolerance. Then when the difference in forces is greater than the tolerance, the command transmitter means transmits instructions to each of the upper and lower squeeze means to interrupt or slow the forward movement of either the upper squeeze means and the lower squeeze means, or whichever of the upper squeeze means or the lower squeeze means has a greater force, until the difference between the forces becomes within the tolerance.

Preferably, the upper and the lower squeeze means are a hydraulic cylinder-type, and also, preferably the driving unit is of a hydraulic-unit-type. Further, the measuring means to measure the upper and the lower squeeze forces are preferably pressure sensors attached to the hydraulic unit.

When the upper and the lower squeeze means are of an electric cylinder-type, and also when the driving unit is of an electric power-supply-unit-type, the measuring means to measure the upper and the lower squeeze force are preferably voltage and amperage meters that measure the voltage and current, and that are attached to an electric power supply unit.

EFFECTS OF THE INVENTION

The method and apparatus of the present invention can control (interrupt or slow) the forward movement of the upper or the lower squeeze member so as to make the difference between the forces acting on the upper and the lower squeeze members be less than the tolerance, such that the upper and the lower squeeze members can move forward under the conditions that the forces imparted to the upper and the lower squeeze members are well balanced between them. For example, when the difference in the forces imparted to the upper and the lower squeeze members is greater than the tolerance, then the forward movement of whichever of the upper or the lower squeeze means has a greater force is interrupted or slowed until the difference between the forces becomes less than the tolerance. In this way the present invention has advantageous effects, such as preventing a mold that is molded from having a wrap or preventing a match plate from being damaged.

THE PREFERRED EMBODIMENT OF THE PRESENT INVENTION

In one embodiment of the present invention, the apparatus for making an upper and a lower mold that have no flask is explained below, based on FIG. 1, which shows the main part of the apparatus for making an upper and a lower mold, FIG. 2, which shows a schematic diagram that includes the main part of the apparatus for making an upper and a lower mold, and FIG. 3, which shows a cross-sectional front view of a part of FIG. 2.

In the apparatus for making an upper and a lower mold of the present invention, as shown in FIG. 1, a molding unit 6 comprises:

an cope and drag flask 2, 3, which hold a match plate 1 between them;

an upper squeeze member 4, which is inserted in the open section of the cope flask 2, which section has no match plate 1, and which can form, in combination with the cope flask 2, a space that molds an upper mold; and two cylinders 5, 5, installed at both the front and rear outer sides of the cope flask 2, as separating means to separate the upper squeeze member 4 from the match plate 1.

Figure 2:
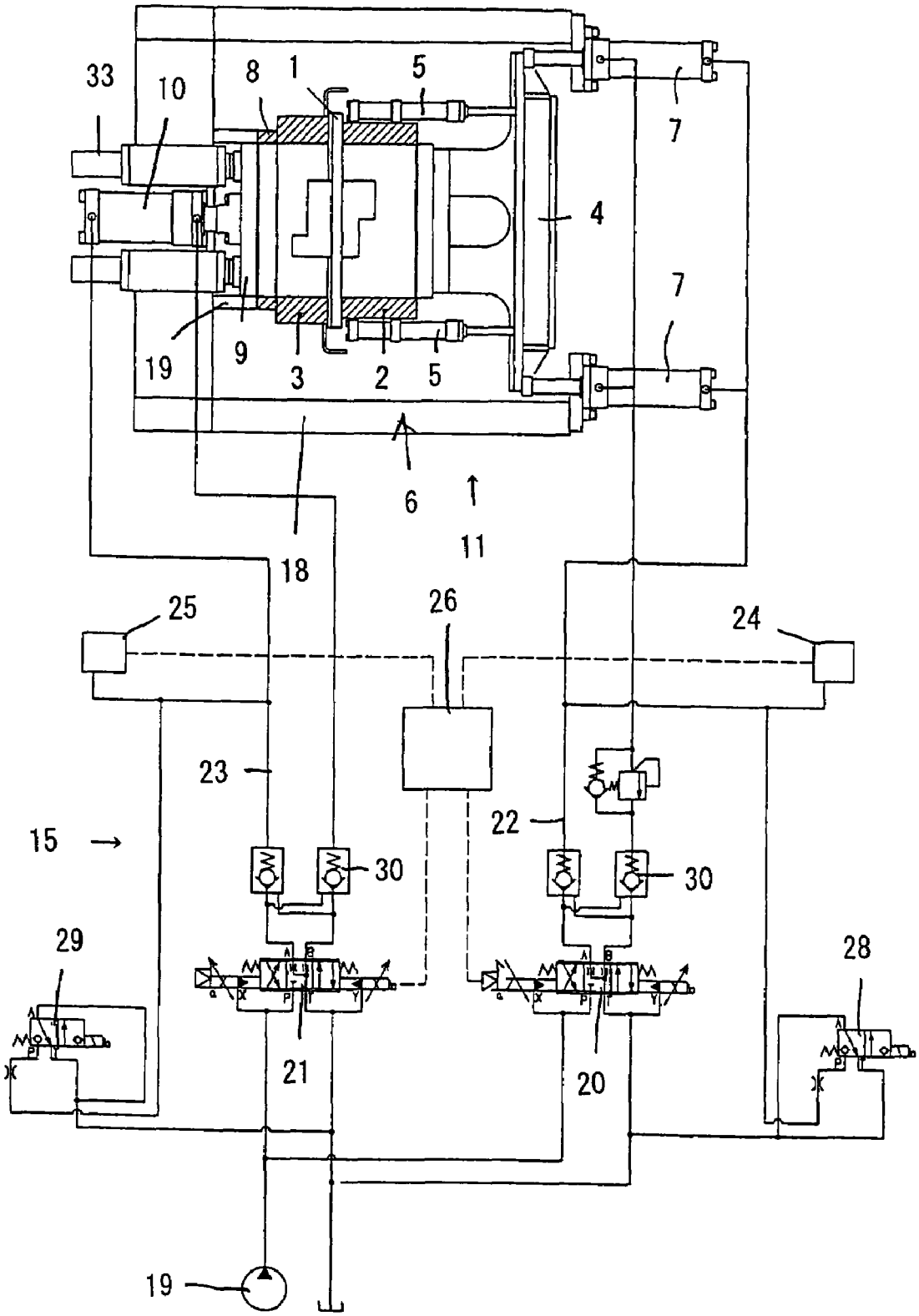
FIG. 2 is a schematic diagram of the main part of the apparatus for making an upper and a lower mold.
Figure 3:
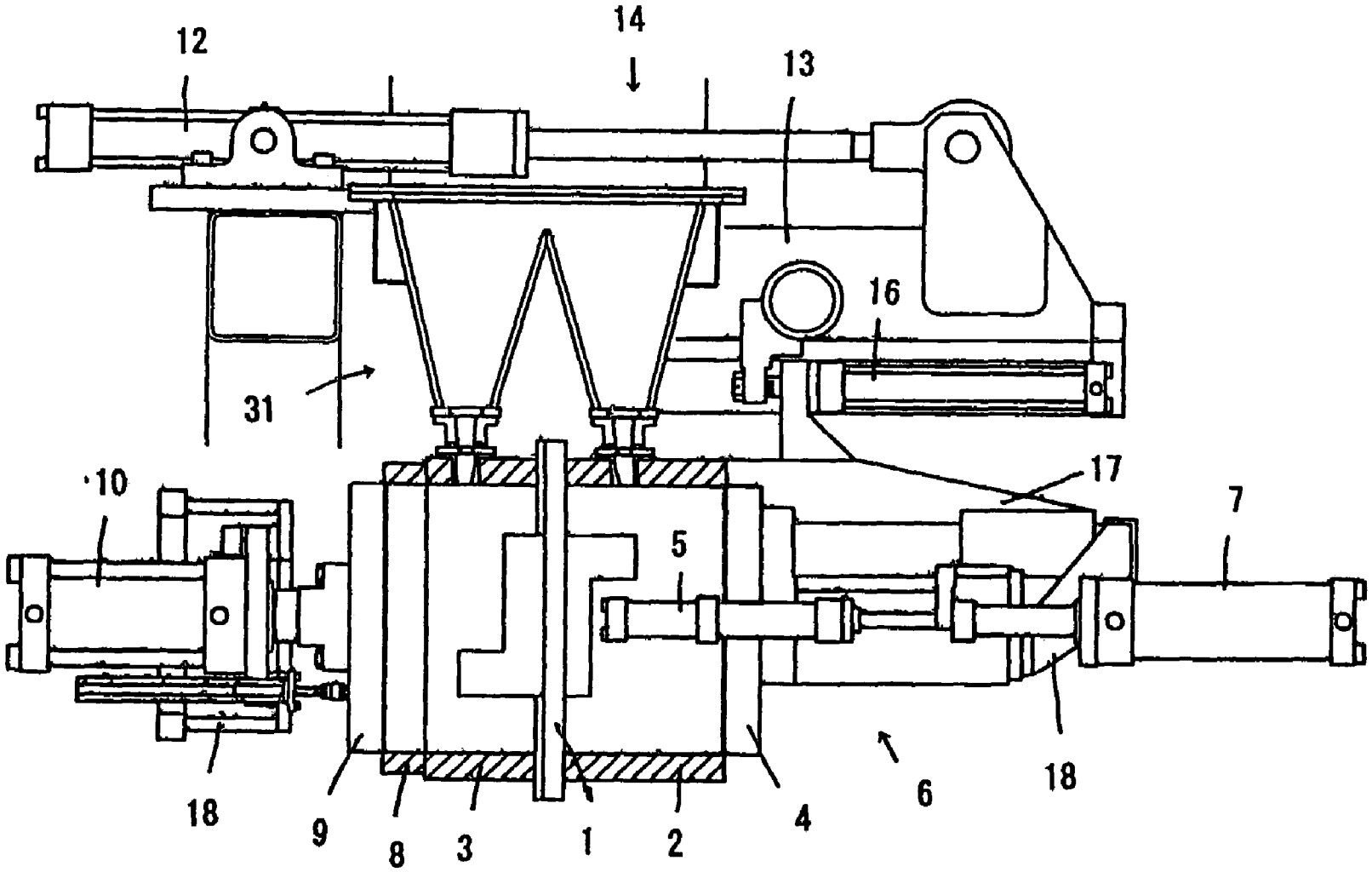
FIG. 3 is a cross-section front view of a part of FIG. 2.

As shown in FIGS. 2 and 3, an actuator 11 comprises:

two upper hydraulic cylinders 7, 7 facing to the left, as upper squeeze means that presses the upper squeeze member 4 to the match plate 1;

a filling frame 8 and a lower squeeze member 9, which can form, in combination with the drag flask 3, a space that can make a mold; and a hydraulic cylinder 10 facing to the right, as lower squeeze means that presses the lower squeeze member 9 to the match plate 1.

The apparatus for making an upper and a lower mold of the present invention further comprises a conveying means 14 which has the molding unit 6 enter or exit from the actuator 11 by the up-and-down movement of the rotating frame 13, which makes an up-and-down rotating movement in a perpendicular plane by the movement of the extension and retraction of a cylinder 12; and a hydraulic power unit 15, which drives, as a driving unit, the upper and lower hydraulic cylinders 7, 7, 10.

The apparatus for making an upper and a lower mold that have no flask, of the present invention, has a mold-stripping unit (not shown). It strips, from the cope and drag flasks after the molding is completed, the upper and lower molds that are contained within the cope and drag flasks. However, an apparatus for making an upper and a lower mold that does not have a mold-stripping unit (not shown) that strips the upper and lower molds can also be used in the present invention.

The match plate 1 is inserted in and taken out from between the cope and drag flasks 2, 3 by the transfer unit (not shown).

In the molding unit 6, as shown in FIG. 3, the drag flask 3 is fitted to the left-hand side of the rotating frame 13, and the cope flask 2 is fitted via guide rods (not shown) to the right-hand side of the drag flask 3. The cope flask 2 can move freely horizontally. The end tip of the piston rod of the cylinder 16, facing laterally to the left, is fitted at the lower part of the rotating frame 13. A connecting member 17 is fixed to the piston rod of the cylinder 16. The cope flask 2 is fixed to the connecting member 17. The cope flask 2 is movable either forward or backward against the drag flask 3 by means of the cylinder 16 extending and retracting.

In the actuator 11, as shown in FIG. 2, the upper hydraulic cylinders 7, 7, are fitted at the right-side end of the fixing frame 18. It has a C-shape when seen from above (plane view). Also, the lower hydraulic cylinder 10 is fitted at the center of the left-hand part of the fixing frame 18. Further, the lower squeeze member 9 is attached to the end of the piston rod of the lower hydraulic cylinder 10. The filling frame 8 is attached to the left-hand part of the fixing frame 18 via a supporting member 19.

Further, in the hydraulic power unit 15, so as to supply the high-pressured oil from a hydraulic pump 19, upper and lower 3 position 4 port (way) open-type valves 20, 21 are connected in parallel to the ports of the upper and lower hydraulic cylinders 7, 7, 10. Further, upper and lower pressure sensors 24, 25, as means to measure the upper and lower squeeze forces at the time of squeezing, are fitted at upper and lower hydraulic pipes 22, 23 that connect the upper and lower 3 position 4 port (way) open-type valves 20, 21 with the intakes of the high-pressure oil, from which intakes the high-pressure oil that works to extend and retract the upper and lower hydraulic cylinders 7, 7, 10 is supplied.

Further, the upper and lower pressure sensors 24, 25, which, by calculating the difference in the squeeze forces as measured by the upper and lower pressure sensors 24, 25 (the squeeze force as converted and calculated from the pressure of the high-pressure oil) and comparing the results of the calculation with the tolerance, control the advancing movement of the upper or lower squeeze member or both, so as to maintain the difference in forces within the tolerance.

The command transmitter means 26 that transmits instructions to 3 position 4 port (way) open-type valves 20, 21 is electrically connected to the upper and lower pressure sensors 24, 25 such that when the difference in forces between the squeeze forces as measured by the upper and lower pressure sensors 24, 25 is greater than the tolerance, the instructions are given to the 3 position 4 port (way) open-type valves 20, 21 of the hydraulic power unit 15, which comprises the upper and lower hydraulic cylinders 7, 10, to, for example, interrupt or slow the advancing movement of whichever of the hydraulic cylinder 7 or 10 has a greater squeeze force, until the difference of the forces becomes less than the tolerance.

In FIG. 2, symbols 28, 29 denote pressure relief circuits (valves). The symbol 30 denotes a check valve with a pilot. In FIG. 3, the symbol 31 denotes a sand-blowing unit for a mold. In FIG. 2, the symbol 33 denotes a guide rod.

Thus, the apparatus for making an upper and a lower mold is formed such that it rotates the rotating frame 13 clockwise by extending the upper hydraulic cylinder 12 of the conveying means 14, under the condition that the upper cylinders 7, 7 of the actuator 11 are retracted, and, as shown in FIG. 2, moves the molding unit 6 into the actuator 11.

During this rotation, the apparatus, by extending the lower hydraulic cylinder 10 to the required length by adjusting the lower 3 position 4 port (way) open-type valves 21 of the hydraulic unit 15, and by also extending and retracting the two cylinders 5, 5, inserts each of the upper and the lower squeeze members 4, 9 into the open section of the cope flask 2, which section has no match plate, of the cope and drag flasks 2, 3 of the molding unit 6, and into the filling frame 8, which flasks hold the match plate 1 between them.

After the lower molding spaces are formed by the drag flask 3 contacting the filling frame 8, the lower 3 position 4 port (way) open-type valves 21, and the like are adjusted. Then molding sand is blown into all the upper and the lower molding spaces by the sand-blowing unit 31.

Then, the upper and the lower hydraulic cylinders 7, 7, 10 are extended by adjusting the upper and lower 3 position 4 port (way) open-type valves 20, 21. Then the upper and the lower squeeze members 4, 9 are moved forward to squeeze the molding sand within the upper and the lower molding spaces.

In this process of squeezing the molding sand, the upper and lower pressure sensors 24, 25 measure the pressure of the high-pressure oil in the upper and lower hydraulic cylinders 7, 7, 10. If the difference in the squeeze forces between the upper and lower squeeze members as measured by the upper and the lower pressure sensors 24, 25 rises to the maximum level of tolerance and both squeeze forces are strong, the command transmitter means 26 transmits the instructions to the pilot section of the upper and lower 3 position 4 port (way) open-type valves 20, 21, to interrupt the supply of the high-pressure oil to the upper and lower hydraulic cylinders 7, 7, 10, and adjusts the upper and lower 3 position 4 port (way) open-type valves 20, 21. In this embodiment the instructions to interrupt the supply of the high-pressure oil are sent to the upper and lower hydraulic cylinders 7, 7, 10. However, instructions to slow the supply of the high-pressure oil can also be given.

In this way, the upper and lower hydraulic cylinders 7, 7, 10 operate and extend the cylinders by means of the residual pressure of the high-pressure oil, and then move the upper and the lower squeeze members 4, 9 forward.

If the difference in the squeeze force as measured by the upper and the lower sensors 24, 25 becomes less than the tolerance, then, after the upper and lower hydraulic cylinders 7, 7, 10 are extended, the upper and lower 3 position 4 port (way) open-type valves 20, 21 again adjusted. Then the supply of the high-pressure oil to the upper and lower hydraulic cylinders 7, 7, 10 is started and the upper and lower hydraulic cylinders 7, 7, 10 resume extending their cylinders.

These movements are repeated. The molding sand within the molding spaces is squeezed and then the upper and lower molds are made.

In the present embodiment, the upper and lower hydraulic cylinders 7, 10 are used as the upper and lower squeeze means. Thus, a hydraulic power unit 15 is used as a driving device. However, in this invention the driving device is not limited to a hydraulic-unit-type. The apparatus can be formed in such way that the upper and lower squeeze means are electric cylinders which can convert a rotational movement of the output axis of the electric motor into a linear movement by using a screw mechanism, and that the driving device can be an electric-power-supply-unit-type. The measuring means for the upper and the lower squeeze forces are voltage and amperage meters built in an electric power supply unit.

The invention claimed is:

1. A method of controlling the operation of an apparatus for making an upper and a lower mold, the apparatus including:

a molding unit having:

a cope flask and a drag flask which hold a match plate between them;

an upper squeeze member, which is inserted in a space of the cope flask, which has no match plate, and which can form a molding space to make the upper mold in combination with the cope flask; and a separating means which is installed on the cope flask to separate the upper squeeze member from the match plate;

an actuator having:

an upper squeeze means to press the upper squeeze member against the match plate;

a filling frame and a lower squeeze member, both of which together can form, in combination with the drag flask, a space to make a lower mold; and a lower squeeze means to press the lower squeeze member against the match plate;

a driving unit which drives the upper and the lower squeeze means; and a conveying means having a rotating frame which can rotate upward or downward in a perpendicular plane, wherein the molding unit is moved into or out of the actuator by the rotating frame and the upper and lower squeeze members are forwarded to the match plate by the upper and lower squeeze means, the method comprising the steps of: measuring an upper squeeze force that the upper squeeze member receives from the upper squeeze means and a lower squeeze force that the lower squeeze member receives from the lower squeeze means;

calculating the difference between the squeeze forces so measured;

comparing the difference between the squeeze forces with a predetermined tolerance of difference between the squeeze forces; and controlling the driving unit to, based on the results of the comparison, stop or slow forward movement of the upper squeeze member or the lower squeeze member or both until the difference between the squeeze forces becomes less than the tolerance.

2. An apparatus for making an upper and a lower mold comprising:

a molding unit having:

a cope flask and a drag flask which hold a match plate between them;

an upper squeeze member, which is inserted in a space of the cone flask, which has no match plate, and which can form a molding space to make the upper mold in combination with the cope flask; and a separating means which is installed on the cope flask to separate the upper squeeze member from the match plate;

an actuator having:

an upper squeeze means to press the upper squeeze member against the match plate;

a filling frame and a lower squeeze member, both of which together can form, in combination with the drag flask, a space to make a lower mold; and a lower squeeze means to press the lower squeeze member against the match plate;

a driving unit which drives the upper and the lower squeeze means; and a conveying means having a rotating frame which can rotate upward or downward in a perpendicular plane, wherein the molding unit is moved into or out of the actuator by the rotating frame and the upper and lower squeeze members are forwarded to the match plate by the upper and lower squeeze means, measuring means attached to the driving unit, for measuring an upper squeeze force and a lower squeeze force that the upper and lower squeeze members receive during squeezing by the upper and lower squeeze means; and a command transmitter means for transmitting instructions, after a difference is calculated between the measured squeeze forces and the difference is compared with a predetermined tolerance of difference between the squeeze forces, to the driving unit that, based on the results of the comparison, stops or slows forward movement of the upper squeeze member or the lower squeeze member or both until the difference between the squeeze forces becomes less than the tolerance.

3. The apparatus for making an upper and a lower mold according to claim 2, wherein the upper and the lower squeeze means are a hydraulic cylinder and wherein the measuring means for measuring the upper and the lower squeeze forces are pressure sensors that measure hydraulic power and are attached to the driving unit.

4. The apparatus for making an upper and a lower mold according to claim 2, wherein the upper and the lower squeeze means are an electric cylinder and wherein the measuring means for measuring the upper and the lower squeeze forces are voltage and amperage meters that measure voltage and current and are attached to the driving unit.

* * * * *